United States Patent [19]

Morinaga

[11] 4,103,117

[45] Jul. 25, 1978

[54] PICK-UP CARTRIDGE

[75] Inventor: Mistuyoshi Morinaga, Tokyo, Japan

[73] Assignee: Trio Kabushiki Kaisha, Tokyo, Japan

[21] Appl. No.: 754,449

[22] Filed: Dec. 27, 1976

[30] Foreign Application Priority Data

Dec. 25, 1975 [JP] Japan ..... 50-157236

[51] Int. Cl.[2] ..... H04R 11/12

[52] U.S. Cl. ..... 179/100.41 Z; 179/100.41 K

[58] Field of Search ..... 179/100.41 Z, 100.41 M, 179/100.41 K; 274/37

[56] References Cited

U.S. PATENT DOCUMENTS

| | | | |
|---|---|---|---|
| 3,441,688 | 4/1969 | Shaper | 179/100.41 K |
| 3,881,073 | 4/1975 | Grado | 179/100.41 Z |
| 3,904,837 | 9/1975 | Sugimoto | 179/100.41 M |
| 4,031,335 | 6/1977 | Smit | 179/100.41 Z |

FOREIGN PATENT DOCUMENTS

| | | | |
|---|---|---|---|
| 1,000,035 | 8/1965 | United Kingdom | 179/100.41 K |

*Primary Examiner*—Bernard Konick

*Assistant Examiner*—Alan Faber

*Attorney, Agent, or Firm*—Lane, Aitken, Dunner & Ziems

[57] ABSTRACT

A pick-up cartridge has a plate-like first magnet magnetized thicknesswise and having a central through hole through which extends a cantilever having on one end a reproducing stylus and on the other end a disc-shaped armature of a highly permeable material, the first magnet being adjacent to the armature. The armature is supported by a damper so as to be vibratable with vibration of the cantilever. At least a pair of spaced coil-carrying pole pieces have their one ends located in the vicinity of and slightly spaced radially from the armature, the other ends of the pole pieces being connected to one polarity side of a second magnet magnetized thicknesswise. The first and second magnets have the same kind of polarity oriented in the same direction. A shield casing has its bottom connected to the other polarity side of the second magnet and disposed to cover the pole pieces and armature, the shield casing having its brim positioned adjacent to the first magnet in peripherally spaced relation.

2 Claims, 4 Drawing Figures

PICK-UP CARTRIDGE

BACKGROUND OF THE INVENTION

Field of the Invention

The present invention relates to an improvement in an electromagnetic pick-up cartridge, and more particularly to a pick-up cartridge of the type having a vibratable armature made of a material of high permeability and connected to the cantilever.

SUMMARY OF THE INVENTION

It is an object of the present invention to provide a pick-up cartridge having an armature of small size, the equivalent mass of the armature as viewed from the stylus being reduced substantially to zero for sound reproduction over a wide frequency band.

Another object of the present invention is to provide a pick-up cartridge having a shield casing whereby a smooth flow of magnetic current can be provided, and the electromechanical translating members can be protected against unwanted magnetic fields.

A still further object of the present invention is to provide a pick-up cartridge in which the windings of coils are less in number than in conventional cartridge for the same output, and hence the length of coil-carrying pole pieces is held at a minimum to diminish loss due to magnetic resistance.

According to the present invention, an armature of a highly permeable material is connected to one end of a cantilever that is opposite to the stylus end. A first magnet is located adjacent to the armature. At least a pair of spaced coil-carrying pole pieces extend parallel to each other and have their free ends located adjacent to the armature in peripherally spaced relation. The other ends of the pole pieces are connected to a second magnet which in turn is coupled to the bottom of a shield casing covering the pole pieces and armature and having its brim ending in the vicinity of the first magnet. The first and second magnets have the same kind of polarity oriented in the same direction.

Many other advantages, features and additional objects of the present invention will become manifest to those versed in the art upon making reference to the detailed description and the accompanying drawings in which preferred structural embodiments incorporating the principles of the present invention are shown by way of illustrative example. Like reference numerals refer to like or corresponding parts throughout the views.

DETAILED DESCRIPTION OF THE PREFERRED EMBODIMENTS

Figure 1:
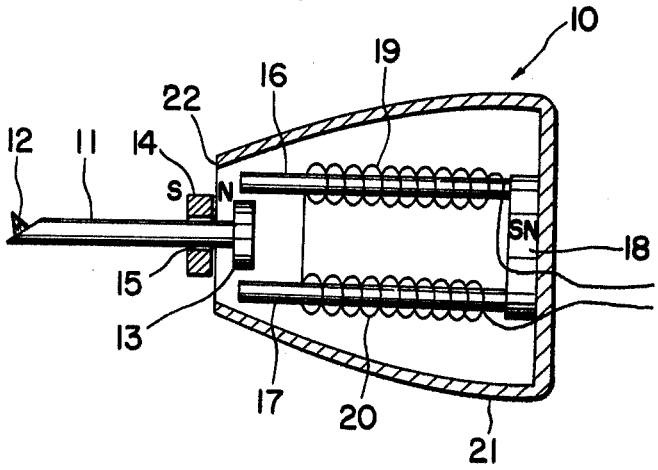
FIG.1 is a longitudinal cross-sectional view of a pick-up cartridge constructed in accordance with the present invention.
Figure 2:
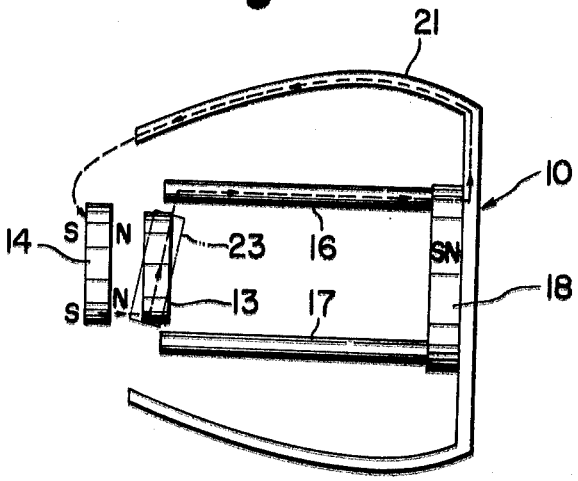
FIG. 2 is a schematic view showing a magnetic circuit formed by the pick-up cartridge shown in FIG. 1.

The principles of the present invention are particularly useful when embodied in a pick-up cartridge such as shown in FIGS. 1 and 2 generally indicated by the numeral 10.

The pick-up cartridge 10 comprises an electromechanical translating structure including a cantilever 11 having on one end a reproducing stylus 12 and on the other end an armature 13 connected thereto at its center, said armature being made of a material of high permeability. The armature 13 is formed in the shape of a disc to reduce the magnetic inclination, and is supported by a damper (not shown) so as to be vibratable with vibration of the cantilever 11. A plate-like first magnet 14 has a central through hole 15 through which the cantilever 11 extends, the magnet 14 being located adjacent to the armature 13. The magnet 14 is magnetized thicknesswish or in the direction of the thickness.

A pair of cylindrical pole pieces 16, 17 are spaced in parallel with each other and have their one ends located in the vicinity of and slightly spaced radially from the armature 13. The other ends of the pole pieces 16, 17 are connected to one polarity side of a plate-like second magnet 18 that is magnetized also thicknesswise. Around the pole pieces 16, 17, there are helically wound a pair of interconnected coils 19, 20, respectively, which can jointly produce one signal output for a single channel in a stereo set. The other polarity side of the second magnet 18 is coupled to the bottom of a shield casing 21 of a magnetic material that is formed and disposed to cover the pole pieces 16, 17 and armature 13, and has its brim 22 positioned adjacent to the first magnet 14 in peripherally spaced relation. The first and second magnets 14, 18 are arranted to orient the same kind of polarity in the same direction.

When the cantilever 11 of the cartridge 10 thus constructed is in non-operative condition, or does not vibrate, the densities of magnetic flux passing through the pole pieces 16 and 17 are equalized. When, on the other hand, the cantilever 11 becomes deflected to thereby shift the armature 13, for example, to the position shown in dotted lines 23 in FIG. 2, a line of magnetic force passing through the pole piece 16 forms a closed loop extending from polarity N of the first magnet 14 through a circumferential portion of the armature 13 that is closer to the magnet 14, the free end of the pole piece 16, hence through the shield casing 21, the brim thereof, to polarity S of the first magnet 14, as illustrated by the arrows. At this time, the magnetic flux density in the pole piece 16 becomes increased and the magnetic flux density in the pole piece 17 becomes reduced. With the interconnected coils 19 and 20 wound in the opposite direction with respect to one another, a doubled output can be obtained.

Figure 3:
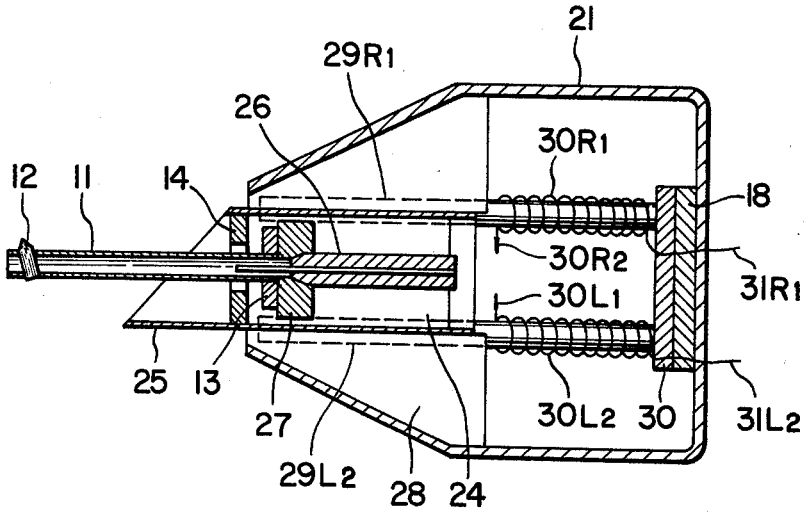
FIG. 3 is a longitudinal cross-sectional view of a stereo pick-up cartridge provided in accordance with the present invention.
Figure 4:
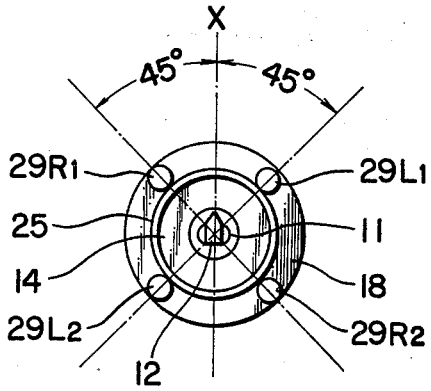
FIG. 4 is a schematic front elevational view illustrating the relative position of coil-carrying pole pieces with respect to a cantilever having a stylus on its free end.

Referring now to FIGS. 3 and 4, the cantilever 11 is attached to a support 24 within a stylus holder 25 by a suspension wire 26. A damper 27 of a resilient material is provided between the armature 13 and the support 24 to thereby support the armature 13. The first magnet 14 in front of the armature 13 is fixed to an inner wall of the stylus holder 25. The stylus holder 25 is supported on a cylinder 28 disposed within the shield casing 21, and can be slid out for replacement. Two pairs of pole pieces $29L_1$, $29L_2$ for a left channel, and $29R_1$, $29R_2$ for a right channel extend along and around the stylus holder 25, and have their free ends corresponding in position to the armature 13. The other ends of the pole pieces 29$L_1$, 29$L_2$, 29$R_1$, and 29$R_2$ are supported by a pole piece holder 30, and extend therethrough for attachment to one polarity side of the second magnet 18. As shown in FIG. 4, the pair of pole pieces 29$L_1$ and 29$L_2$ are diametrically opposite to each other, and the pair of pole pieces 29$R_1$ and 29$R_2$ and diametrically opposite to each other, each pole piece being circumferentially spaced 90° apart from adjacent pole pieces. The pole pieces 29$L_1$ and 29$R_1$ are spaced 45° apart from a longitudinal axis x of the reproducing stylus 12.

A coil 30$R_1$ is wound around the pole piece 29$R_1$ and is connected to an unshown coil 30$R_2$ that is wound around the pole piece 29$R_2$ in an opposite direction to the coil 30$R_1$. Likewise, a coil 30$L_2$ is wound around the pole piece 29$L_2$ is connected to an unshown coil 30$L_1$ that is wound around the pole piece 29$L_1$ in an opposite direction to the coil 30$L_2$. Thus, the coils 30$R_1$ and 30$R_2$ jointly produce a doubled output between their lead wires one of which is indicated at 31$R_1$, and the coils 30$L_1$ and 30$L_2$ jointly produce a doubled output between their lead wires one of which is indicated at 31$L_2$. As in the embodiment shown in FIG. 1, the opposite polarity side of the second magnet 18 is coupled to the bottom of the covering shield casing 21 having the brim ending near the first magnet 14.

With the cartridge construction according to the invention, a high density of magnetic flux can be obtained by utilization of an armature of high permeability and of first and second magnets, and an armature can be reduced in size because the armature and the first magnet are located adjacent to each other. Furthermore, since the armature is made thinner than heretofore, it can be mounted adjacent to a fulcrum of vibration of the cantilever, with the result that the equivalent mass of the armature as viewed from the stylus is substantially zero.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A pick-up cartridge comprising:

a plate-like first magnet having a central through hole therein;

a cantilever extending through said central through hole and having a reproducing stylus mounted at one end of said cantilever;

an armature made of a high permeability material and of a size and shape substantially the same as said first magnet, connected at its center to the other end of said cantilever, located adjacent to said first magnet, and supported by a damper so as to be vibratable with vibration of said cantilever;

a first pair of spaced coil-carrying elongated pole pieces each having a first end and a second end opposite said first end, wherein their respective first ends are located in the vicinity of and slightly spaced radially from said armature to define gaps therebetween; and a plate-like second magnet connected to the respective second ends of said first pair of pole pieces, said first and second magnets being arranged to have the same polarities oriented in the same directions.

2. A pick-up cartridge according to claim 1 further comprising a second pair of spaced coil-carrying elongated pole pieces each having a first end and a second end opposite said first end, wherein their respective first ends are located in the vicinity of and slightly spaced radially from said armature to define gaps therebetween, the respective second ends of said second pair of pole pieces being connected to said second magnet, said pole pieces being spaced at 90° intervals about a central axis aligned substantially in parallel with the longitudinal axes of said pole pieces, and two adjacent pole pieces being positioned symmetrically relative to the longitudinal axis of said reproducing stylus.

* * * * *